US005427308A

United States Patent [19]

Swift et al.

[11] Patent Number: 5,427,308

[45] Date of Patent: Jun. 27, 1995

[54] CONTAINER WITH INTEGRAL HANDLES AND LOCKING TABS

[75] Inventors: Daniel P. Swift, Laramie, Wyo.; Thomas R. LaCroix, Grand Junction; William E. Bullock, Glenwood Springs, both of Colo.; Thomas H. Stewart, Dallas, Tex.

[73] Assignee: Eco-Cool, Inc., Laramie, Wyo.

[21] Appl. No.: 288,559

[22] Filed: Aug. 10, 1994

[51] Int. Cl.[6] ..... B65D 43/08

[52] U.S. Cl. ..... 229/125.27; 229/114; 229/117.15; 229/125.29

[58] Field of Search ..... 229/114, 117.13, 117.14, 229/117.15, 117.22, 125.27, 125.29

[56] References Cited

U.S. PATENT DOCUMENTS

| | | | |
|---|---|---|---|
| 1,987,063 | 1/1935 | Hinton | 229/117.15 |
| 2,618,429 | 11/1952 | Donnell | 229/125.29 |
| 2,785,846 | 3/1957 | Weiner | 229/117.22 |
| 3,006,532 | 10/1961 | Fine | 229/125.29 |
| 3,093,294 | 6/1963 | Kusunoki | 229/117.15 |
| 3,146,937 | 9/1964 | Vesak | 229/117.22 |
| 3,371,846 | 3/1968 | Detzel | 229/117.22 |
| 4,403,728 | 9/1983 | Koltz | 229/117.22 |
| 4,487,319 | 12/1984 | Barrash . | |
| 4,930,681 | 6/1990 | Fultz et al. | 229/125.27 |
| 4,981,254 | 1/1991 | Depper | 229/117.14 |
| 5,018,637 | 5/1991 | Miller | 229/117.14 |
| 5,234,158 | 8/1993 | Storms . | |

FOREIGN PATENT DOCUMENTS

| | | | |
|---|---|---|---|
| 2663904 | 1/1992 | France | 229/117.13 |

*Primary Examiner*—Gary E. Elkins

[57] ABSTRACT

Containers having a container carrying body (30) and a removable lid (29) portion, both formed of thin light weight sheet material, and including a combined latching (13) and handle (9) system carried by the container carrying body (30). The handles (9) and locking tabs (13) are integrally attached to the carrying body (30). The lid (29) includes an opening through which the handle (9) can pass, and slots which can be engaged by the locking tabs (13) to secure the lid (29) to the container body (30). The tabs (13) are placed into locking position when the handles (9) are lifted into the carrying position through the lid (29). The handles (9), locking tabs (13), and container body (30) may be stamped from a single piece of thin light weight sheet material, thereby simplifying its construction and adding to the economy of the container. In one modification, the configuration of the carrying handles (9) allows a slotted liner (27) to be slipped over the handles (9), before the lid (29) is attached. Where the liner (27) is waterproof this renders the interior of the carrying body (30), and thus the container, waterproof, from the inside and so suitable as a cooler or for carrying liquids. As a substitute to a liner (27), coatings or films may be applied to the inside or outside surfaces of the container body (30) to make the container waterproof, increase its durability, enhance its thermal insulation qualities, or to provide other needed characteristics.

15 Claims, 4 Drawing Sheets

CONTAINER WITH INTEGRAL HANDLES AND LOCKING TABS

BACKGROUND OF THE INVENTION (a) Field of the Invention

This invention relates to improvements in containers formed of thin light weight sheet material, and is comprised of a container carrying body and a lid portion, wherein an improved latching and handle system carried by the container carrying body fastens a removable lid into place on the container carrying body when the handles are placed in the carrying position through an opening in the lid.

(b) Description of the Prior Art

Many forms of lightweight cartons and containers exist which utilize handles and a variety of latching mechanisms. Most forms of such containers are intended for a single use, so that they are often destroyed while gaining access the contents of the container. Whether the container is destroyed or not, the latches are normally intended for limited use, are deformed or torn during the opening process, and so are not designed for reuse. Further, most lightweight cartons are formed from cardboard or corrugated paper, and are not designed to receive and secure leak proof linings which would allow the container to be usable as an ice containing cooler for wrapped food or cans, or to carry fluids, or for other specialized functions.

Consideration in the past has been given to providing handles and various forms of latches to a cardboard container, though there are disadvantages to the present designs. A cardboard container with a paperboard top and handle is described in U.S. Pat. No. 4,487,319 to Barrash (1980). The handle is integral with the paperboard top which is adhered to the cardboard bottom. The disadvantage of this design is that the lid is not removable and replaceable. Furthermore, the load from the container is transferred through adhesives to the handle. Failure of the adhesive would cause the container to fail. Integral latching tabs are described in U.S. Pat. No. 5,234,158 to Storms, et al. (1992). These tabs, though holding the lid in place under light loads, do not lock. The described container does not have a handle, and is of limited use.

SUMMARY OF THE INVENTION

Accordingly, the object of this invention is to address and to correct as many of the disadvantages of the currently produced containers as possible.

This present invention teaches improvements in containers formed of thin, light weight sheet material, and having a container carrying body and a lid portion. The improvement includes a combined latching and handle system carried by the container carrying body, and a removable lid which is designed to allow the handle to pass through the lid and the latching mechanism to secure the removable lid. As a result, the removable lid is secured in place on top of the container carrying body when the handles are placed in the carrying position through an opening in the lid.

As set forth in greater detail below, the present invention provides a container with locking tabs integrally attached to the carrying body of the container, and with handles that are integrally attached to the locking tabs, and by that to the carrying body. The easily removable and replaceable lid includes an opening through which the handle can pass, and slots that can be engaged by the locking tabs. When in locking and carrying position, the handles and tabs engage slots in a removable lid, the tabs being placed into locking position when the handles are lifted into the carrying position through the lid, thereby securing the removable lid. When so secured, the container may be used for a variety of purposes such as a cooler, a picnic basket, storage bin, and a myriad of other container uses. The locking tabs prevent the lid from being dislodged when the container is being carried or transported with the handles up in the carry position. Furthermore, when the handles are retracted into the lid slot, the containers are stackable.

When the container body is open, the configuration of the carrying handles allows a suitably slotted liner to be slipped over the handles, before the lid is attached. Where the liner is waterproof, for example of plastic, this renders the interior of the carrying body, and thus the container, waterproof, from the inside and so suitable as a cooler or for carrying liquids. Regardless of its composition, the liner is removable and disposable, thereby allowing the body of container to be reused, or to be recycled in an uncontaminated state. When such a liner is present, then, as detailed below, opening the handles to reach the container contents also opens the liner. As a substitute to a removable liner, coatings or films may be applied to the inside or outside surfaces of the container body to make the container waterproof, increase its durability, enhance its thermal insulation qualities, or to provide other needed characteristics.

Another unique feature of the present invention is the fact that the handles are integral to the carrying body of the container, thus failure of the container handles is reliant on the container material and not on adhesives or separate mechanical latches or connectors. Another advantage of the container design of the present invention is that the handles, locking tabs, and container body may be stamped from a single piece of thin, light weight sheet material, thereby simplifying its construction and adding to the economy of the container.

As used herein, "thin, light weight sheet material" shall mean and include plain cardboard, corrugated cardboard, heavy weight paper, treated paper, flexible polymeric material, metal foil, and art known equivalent material.

Accordingly, besides the objects and advantages of providing a container with integral handles and locking tabs described above, several other objects and advantages of the present invention are to provide a container with integral handles and locking tabs that lock the lid in place by pushing locking tabs into slots in the lid when the handles are in the carrying position.

Another object of the present invention is to provide a container with integral handles and locking tabs that unlock the lid by retracting the locking tabs from the lid slots when the handles are retracted from the carrying position.

Still another object of the present invention is the provision of a container body with integral handles and locking tabs, all of the same thin, lightweight sheet material to improve the strength of the unit.

Yet another object of the present invention is the provision of a container with integral handles and locking tabs constructed of one piece of thin, lightweight sheet material that can be economically manufactured with existing equipment.

Yet a further object of the present invention is to provide a container with integral handles, locking tabs and a removable lid that with an exterior or interior coating, or removable lining is waterproof and suitable to use as a cooler or to carry fluids.

Yet another object of the present invention is to provide a container with integral handles, locking tabs and removable lid that with the proper coatings or removable linings is biodegradable.

Yet a further object of the present invention is to provide a container with integral handles, locking tabs and removable lid that with the proper coatings or removable linings is recyclable.

Yet a further object of the present invention is to provide a container with integral handles, locking tabs and removable lid, which with the lid in place and the handles in the retracted position, can be stacked directly on top of one another.

Yet a further object of the present invention is to provide a container with integral handles, locking tabs and removable lid that the body and lids may be stacked inside one another or stacked flat in order to conserve shipping and storage space, and which, when removed from the nested stack, are easily folded into a carrying body and lid.

Yet a further object of the present invention is to provide a container with integral handles, locking tabs and removable lid that can be shipped flat and easily assembled at the destination.

These and other objects of the present invention will become apparent to those skilled in the art from the following detailed description, showing the contemplated novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
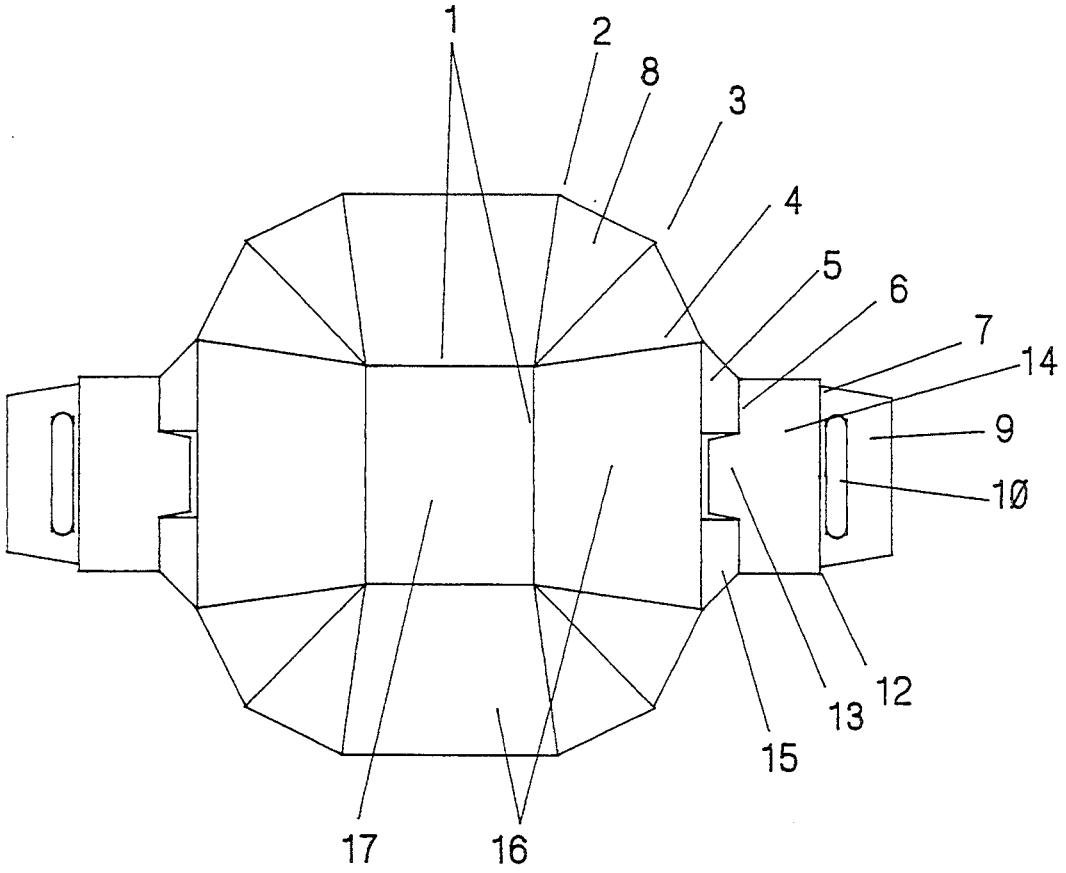
FIG. 1 is a plan view of the container body blank in the unfolded form.
Figure 3:
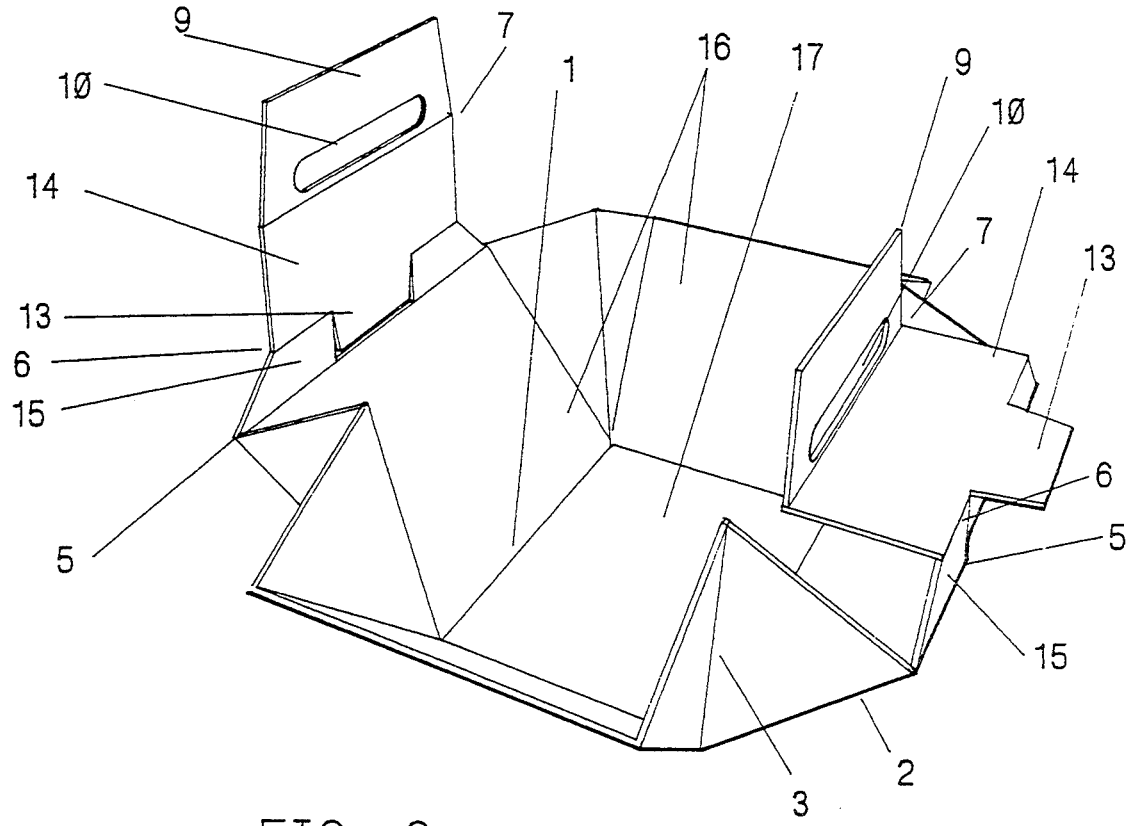
FIG. 3 is an isometric view of the container body partially folded, detailing one step in the container assembly.
Figure 4:
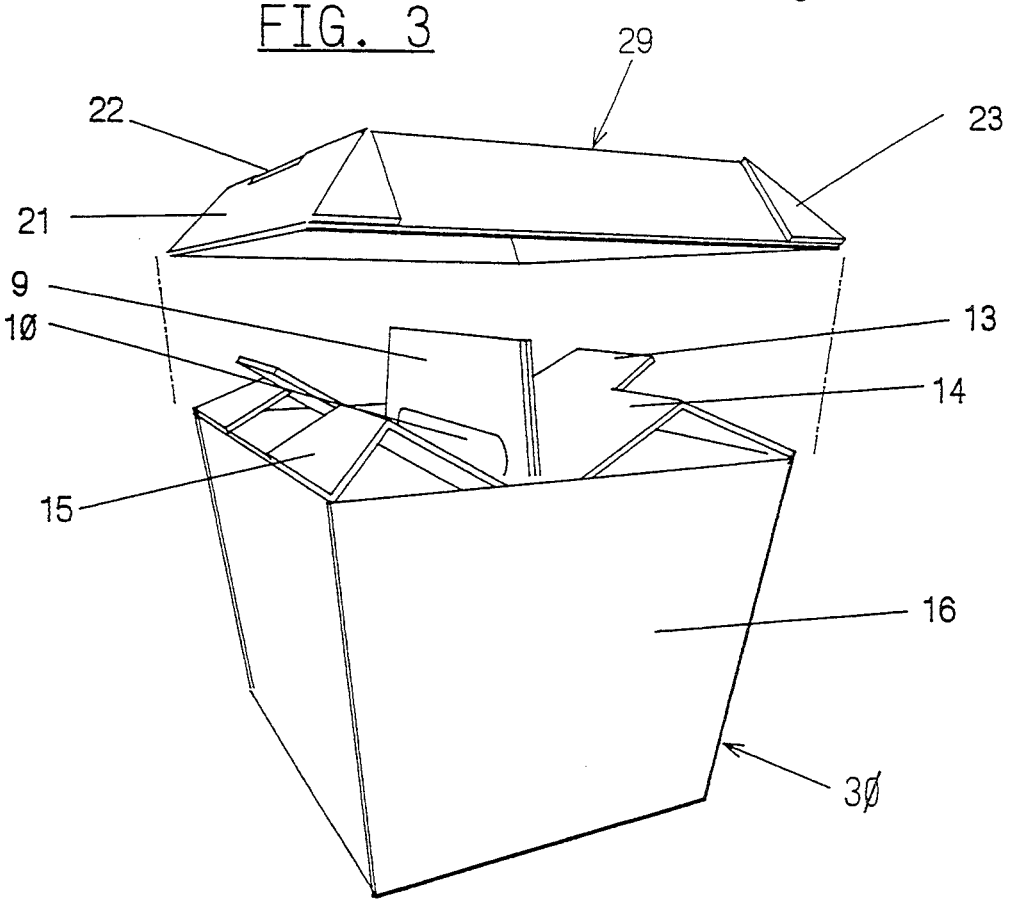
FIG. 4 is an exploded isometric view of the container body and lid, both fully folded and assembled, with the handles and locking tabs of the container body in the release position.

A typical unfolded flat blank of the container body of the present invention is illustrated in FIG. 1. The blank is cut, for example by stamping, from a single piece of thin, flat lightweight sheet material. The blank includes scored fold lines so that when the material is folded along the lines, as shown in FIGS. 3 and 4, so that a single piece container body 30 (FIG. 4) can be formed. Container body 30 include integral sloped side walls 16, and bottom wall 17 with corner panels 8 being mechanically or adhesively attached to side walls 16. Corner panels 8 are folded inside container body 30. Locking tab bodies 14 are integrally connected to side walls 16 of container body 30 by body spacers 15. Handles are formed and integrally connected to body spacers 15 by locking tab body 14. The handles are formed of handle tabs 9 which are connected to locking tab body 14, and define handle holes 10. Locking tab body 14 also carries locking tab 13.

The method of assembling the container body is further illustrated in FIG. 3. Corner panels 8 are folded inward along fold lines 2, 3, and 4. The side walls 16 are folded upward along fold Lines "A" 1. Corner panels 8 are then folded tight and adhesively or mechanically fastened with fold over panels, locking tabs, slip on clips or other art known devices to the inside of the side walls 16, so that a single piece container body is formed. Tab body spacer 15 is then folded inward along fold line 7, locking tab body 14 is folded inward and the handle tab 9 is folded upward thus forming a container body with integral handles and locking tabs ready to receive a suitable lid.

Figure 2:
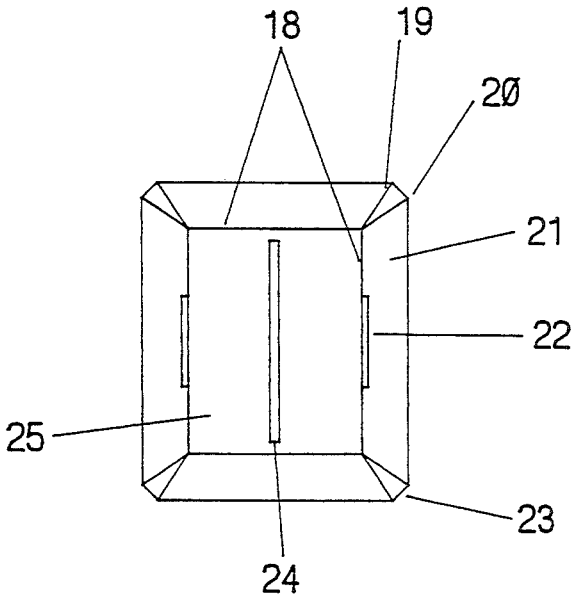
FIG. 2 is a plan view of the container lid blank in the unfolded form.
Figure 5:
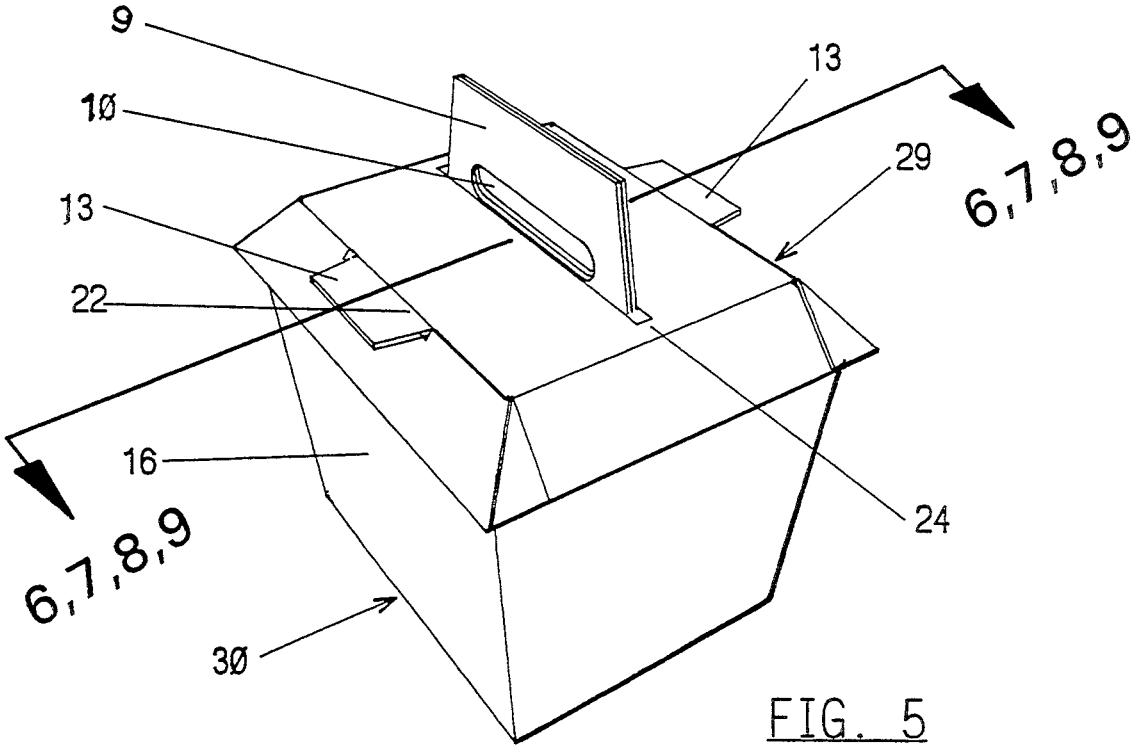
FIG. 5 is an isometric view of the container with the lid in place on the container body and the handles and locking tabs in the locked position.

An accompanying flat lid blank is illustrated in FIG. 2. A lid top panel 25 is connected to lid side panels 21 along fold lines 18. Locking tab slots 22 and handle tab slot 24 are defined by the blank. Scored fold lines 19 allow corner tabs 23 to be folded and adhesively or mechanically fastened to form a lid 29, as illustrated in FIGS. 4 and 5.

The method of attaching lid 29 to the container body 30 is illustrated in FIG. 4. First lid 29 is centered over container body 30. Then handle tabs 9 are held together, and while in a retracted position (FIGS. 4 and 6), and inserted through handle tab slot 24 in lid 29. Lid 29 is pressed onto container body 30 until locking tab slots 22 in lid 29 are aligned with locking tabs 13. Then, pulling the handle tabs 9 upward and through lid 29 causes locking tab body 14 to rotate upward and push locking tabs 13 through locking tab slots 22, thus locking the lid 29 in place. FIGS. 5 and 7 illustrate lid 29 seated on container body 30 with the handle tabs 9 in the carrying position and locking tabs 13 fully extended into the locking tab slots 22.

Figure 6:
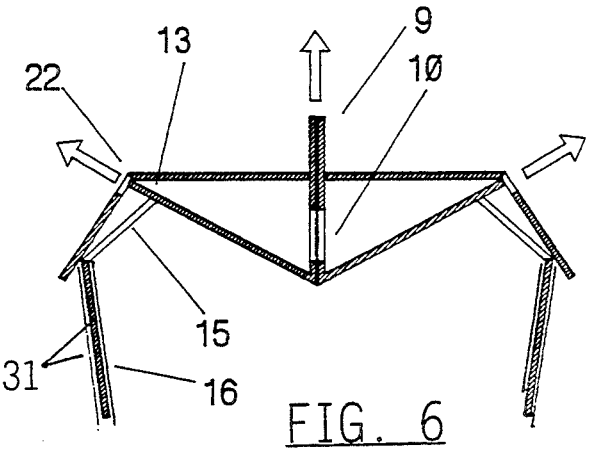
FIG. 6 is a cross-sectional view taken at 6—6 of FIG. 5, showing the handles and locking tabs in the released position.
Figure 7:
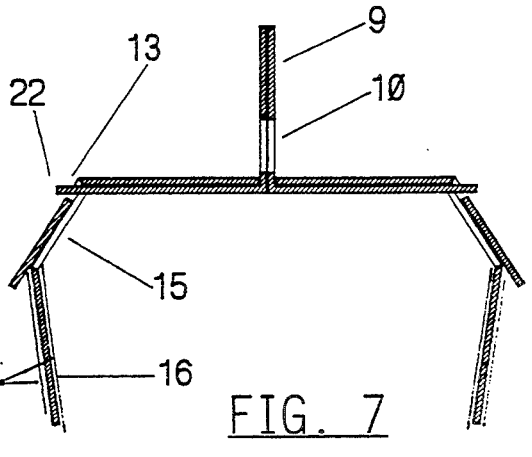
FIG. 7 is a cross-sectional view, similar to FIG. 6, showing the handles and locking tabs in the locked position.

FIG. 6 is a cross-sectional view showing the handles and locking tabs in the released position, with locking tabs 13 retracted from locking tab slots 22 in lid 29, to thereby provide an easy and nondestructive method of opening the container. When the handles are pushed back toward the surface of lid 29, thereby retracting the handles from the carrying position, then locking tabs 13 are retracted from the lid slots 22 to unlock lid 29.

FIG. 7 is a cross sectional view, similar to FIG. 6 showing the handles and locking tabs in the locked position. When the handles are lifted into the carry position as shown, the locking tabs 13 are caused to push outward and upward to engage locking tab slots 22, thereby locking the lid 29 in place.

Figure 8:
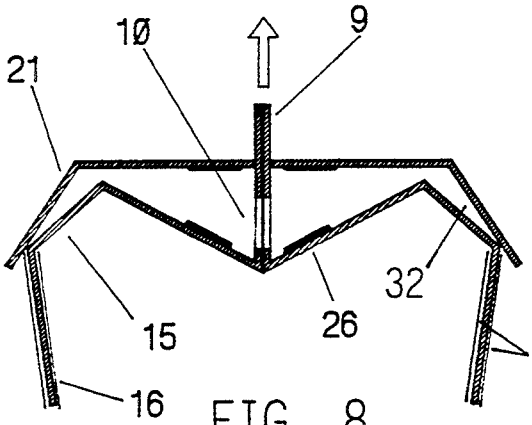
FIG. 8 is a cross-sectional view, similar to FIG. 6, showing an alternate embodiment with locking tabs of adhesive or interlocking fiber material available under the trade name Velcro, showing the handles and locking tabs in the released position.

FIG. 8 is a cross sectional view, similar to FIG. 6 showing an alternate latching method consisting of tabs 26, with adhesive surfaces or interlocking fiber surfaces available under the trade name 'Velcro'. The handles and tab surfaces are shown in the released position. When the handles are pushed into the released position, the tab 26 surfaces are forced apart, releasing the lid, thereby providing an easy nondestructive means of opening the container.

Figure 9:
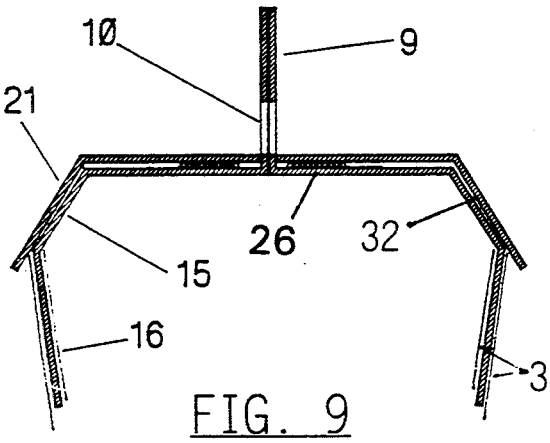
FIG. 9 is a cross-sectional view, similar to FIG. 6, showing an alternate embodiment with locking tabs of adhesive or interlocking fiber material available under the trade name Velcro, showing the handles and locking tabs in the locked position.

FIG. 9 is a cross-sectional view, similar to FIG. 6 showing the handles in the carry position. When the handles are lifted into the carry position, tab 26 surfaces are reengaged, locking the lid 29 in place.

Figure 10:
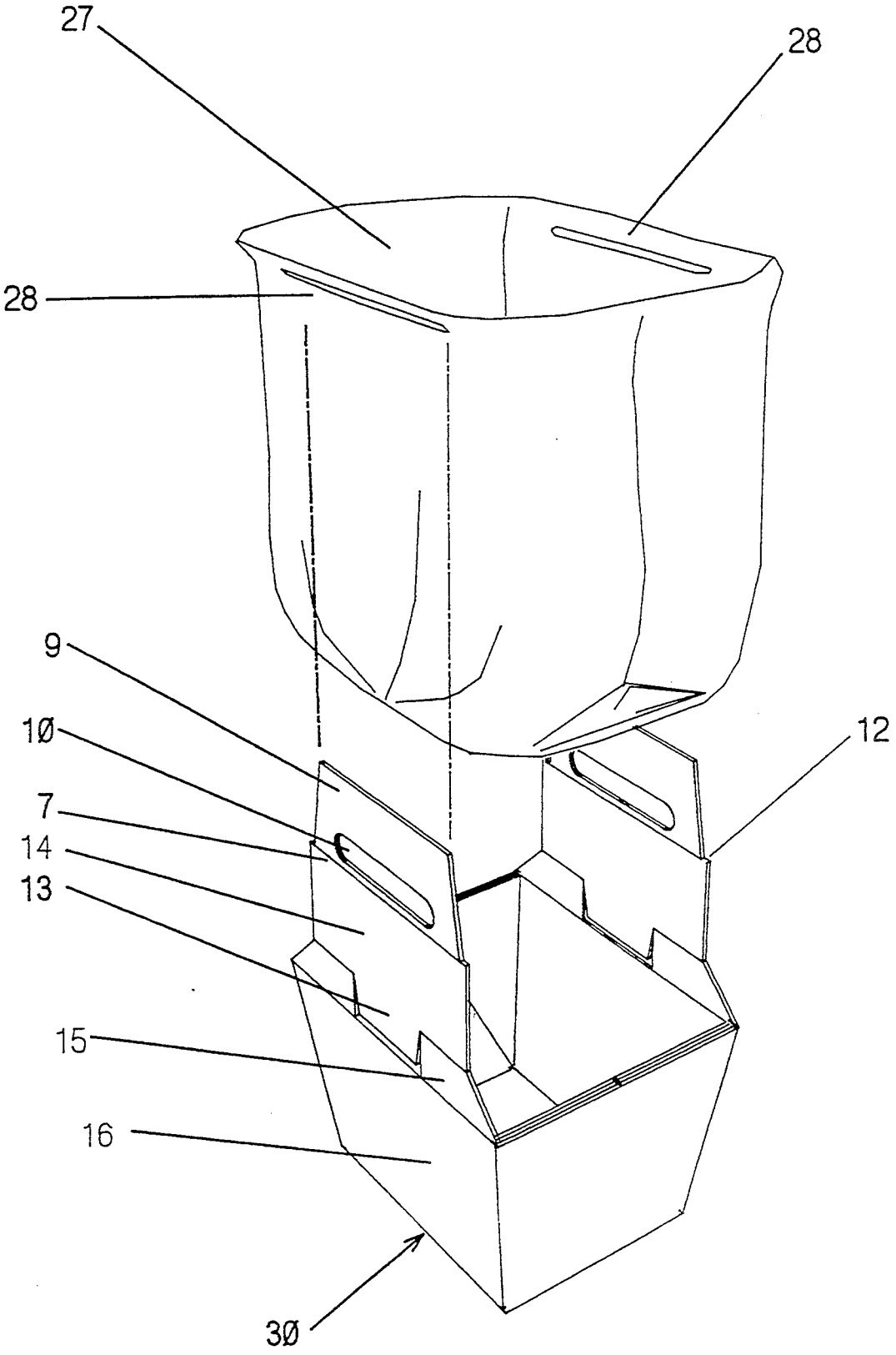
FIG. 10 is an exploded isometric view of the container body with a removable liner positioned for insertion into the container body.

FIG. 10 is an exploded isometric view of container body 30 with a removable liner bag 27 positioned for insertion into the container body. Liner bag 27 includes liner slots 28, and is inserted into container body 30 with liner slots 28 handle tabs 9 inserted through liner slots 28 until it engages liner stop 12 carried by locking tab body 14. The liner bag 27 is thus held in place by the handles, and opens automatically when the handles are pulled open.

Accordingly, it will be seen that the integral handle and locking tabs of this invention increase the usability of a container for carrying objects. The shape of the lid and container body, coupled with the design of the latching system, provides a container with an easy and nondestructive method of opening, closing, and sealing a lid.

It is further seen that the present invention addresses and corrects many of the disadvantages of the currently produced containers. It provides a container with integral handles and locking tabs that serve to lock a properly configured lid in place by pushing locking tabs into slots in the lid when the handles are in the carrying position, and in which, when the handles are retracted from the carrying position, the lid is unlocked by retracting the locking tabs from the lid slots. It further provides a container body with integral handles and locking tabs, all of which are made from one piece of the same thin, lightweight sheet material, thereby improving the strength of the unit, and allowing it to be economically and easily manufactured with existing equipment and technology. In one modification of the present invention, the container has a removable lining, which may be waterproof and suitable to use as a cooler or to carry fluids. In another modification combinations of interior and exterior coatings are provided, for example to waterproof or insulate the container. In either instance, the coatings or removable linings may be biodegradable or recyclable. In addition, the present invention provides a container with integral handles, which, with the lid in place and the handles in a retracted position, can be stacked directly on top of one another, and in which the body and lids may be stacked inside one another or stacked flat in order to conserve shipping and storage space, and which, when removed from the nested stack, are easily folded into a carrying body and lid at their destination.

Although the description above contains many specificities, these should not be construed as limiting the scope of the invention but as merely providing illustrations of some of the presently preferred embodiments of this invention. For example, where two handles and locking tabs are shown in the drawings, a single handle and locking tab would be suitable for an alternative embodiment. The lid and container may have a variety of sizes and shapes, such as polygonal, straight sided, and the like. The lid may be fastened to or continuous with one or more edges of the container body thus forming a hinged assembly held closed by one or more handles and locking tabs.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

Thus the scope of the invention should be determined by the appended claims and their legal equivalents, rather than by the examples given.

We claim:

1. A container having a container carrying body and a removable lid, wherein the improvement includes:

said container carrying body including a plurality of side walls which define a container cavity;

a combined latching system and handle system carried by said container carrying body;

a. said latching system including latching means attached to one or more of said side walls of said carrying body of said container, said latching means moveable between an unlatched position and a latched position with said lid;

b. said handle system including one or more handles each handle being attached to one of said latching means, and thereby to said carrying body, said handle system moveable between a recessed position and a carrying position; whereby when said handle system is moved from its recessed position to its carrying position, said latching means is caused to move from its unlatched position to its latched position; and a removable lid;

a. said removable lid defining at least one opening which is positioned to permit said handle system to pass through said lid from its recessed position to its carrying position when said lid is located in a position to close said container cavity;

b. said removable lid further defining at least one more opening which is positioned to receive said latching means as it moves from its unlatched position to its latching position in response to said handle system being moved from its recessed position to its carrying position, to thereby cause said latching means to releaseably secure said removable lid;

whereby said removable lid is secured in place to said container carrying body when said handle system is placed in the carrying position through said handle opening in said lid, and said removable lid is released from said container carrying body when said handle system is placed in its recessed position.

2. The container of claim 1 wherein at least two latching means are attached to at least two of said side walls of said carrying body of said container, and wherein further there are at least two openings in said lid which are positioned to receive said at least two said latching means.

3. The container of claim 2 wherein said carrying body of said container includes at least two side walls which are substantially opposed to one another, and at least one of said latching means is attached to each said opposed side wall; and wherein further, at least two said openings in said lid are substantially opposed to one another to receive said opposed latching means.

4. The container of claim 3 wherein said carrying body of said container includes two side walls which are substantially opposed to one another, and at least one said latching means is attached to each of said two opposed side walls; and wherein further, two openings in said lid are located substantially opposed to one another to receive said two opposed latching means.

5. The container of claim 4 wherein said latching means are tabs, and said openings in said lid are slots which can be engaged by said tabs.

6. The container of claim 1 wherein said latching means are integral with and formed of the same material as said carrying body of said container.

7. The container of claim 6 wherein said latching means are integral with and formed of the same material as said handle system.

8. The container of claim 1 wherein said latching means are integral with and formed of the same material as said carrying body of said container, and said handle system is integral with and formed of the same material as said latching means and said carrying body.

9. The container of claim 8 wherein said carrying body of said container is formed of thin, light weight sheet material.

10. The container of claim 1 wherein said container is coated with additive means to improve resistance to fluids, resistance to dust penetration, thermal insulation characteristics, and durability.

11. A container having a container carrying body and a removable lid, wherein the improvement includes:

said container carrying body including a plurality of side walls which define a container cavity, including at least two side walls which are substantially opposed to one another;

a combined latching system and handle system carried by said container carrying body;

a. said latching system including two latching means, at least one of said latching means attached to each of said opposed side walls of said carrying body of said container, said latching means moveable between an unlatched position and a latched position with said lid;

b. said handle system including two handles, each handle attached to each of said latching means, and thereby to said carrying body, said handle system moveable between a recessed position and a carrying position; whereby when said handle system is moved from its recessed position to its carrying position, said latching means is caused to move from its unlatched position to its latched position; and a removable lid;

a. said removable lid defining at least one opening which is positioned to permit said handle system to pass through said lid from its recessed position to its carrying position when said lid is located in a position to close said container cavity;

b. said removable lid further defining at least two additional openings in said lid, which openings are substantially opposed to one another and positioned to receive said two said latching means as they move from their unlatched position to their latched position in response to said handle system being moved from its recessed position to its carrying position, to thereby cause said latching means to releaseably secure said removable lid to said carrying body;

whereby said removable lid is secured in place to said container carrying body when said handle system is placed in the carrying position through said handle opening in said lid, and said removable lid is released from said container carrying body when said handle system is placed in its recessed position.

12. The container of claim 11 wherein said latching means are integral with and formed of the same material as said carrying body of said container, and said handle system is integral with and formed of the same material as said latching means and said carrying body.

13. The container of claim 11 wherein a liner is sized to be placed within said body of said container before the lid is attached.

14. The container of claim 13 wherein said liner is waterproof and leak proof.

15. The container of claim 13 wherein said liner carries two openings which are substantially opposed to one another and positioned to receive said two handles therethrough, so that when said handle system is placed in the carrying position said liner is substantially closed, and when said handles are separated said liner is opened.

* * * * *